United States Patent [19]

Justice

[11] Patent Number: 4,763,955

[45] Date of Patent: Aug. 16, 1988

[54] PITCH SEAM MINING

[75] Inventor: James C. Justice, Beckley, W. Va.

[73] Assignee: Coaltex, Inc., Beckley, W. Va.

[21] Appl. No.: 534,651

[22] Filed: Sep. 22, 1983

[51] Int. Cl.[4] ..... E21C 35/20

[52] U.S. Cl. ..... 299/56; 299/18; 299/67

[58] Field of Search ..... 299/18, 31, 56, 67, 299/68

[56] References Cited

U.S. PATENT DOCUMENTS

| | | | |
|---|---|---|---|
| 3,556,599 | 1/1971 | Fiske | 299/11 |
| 3,943,644 | 3/1976 | Walz | 198/109 |
| 4,120,535 | 10/1978 | Delli-Gatti | 299/18 |
| 4,123,109 | 10/1978 | Hill | 299/31 |
| 4,225,186 | 9/1980 | Stratton | 299/18 |
| 4,280,732 | 7/1981 | Haspert | 299/18 |
| 4,330,155 | 5/1984 | Richardson et al. | 299/56 |
| 4,332,420 | 6/1982 | Coski | 299/56 |

FOREIGN PATENT DOCUMENTS

| | | | |
|---|---|---|---|
| 936869 | 9/1963 | United Kingdom | 299/18 |
| 1049388 | 11/1966 | United Kingdom | 299/18 |
| 909157 | 2/1982 | U.S.S.R. | 299/18 |

OTHER PUBLICATIONS

Link-Belt Company Catalog, 1950, pp. 1116, 1117, 1127–1130, 1137, 1145, 1146, 1150.

*Primary Examiner*—Jerome Massie
*Assistant Examiner*—Willaim P. Neuder
*Attorney, Agent, or Firm*—Nixon & Vanderhye

[57] ABSTRACT

A miner, and method of mining, are provided for pitch seam mining of coal. The cutting heads powered from a power source at the mouth of the seam are introduced into the seam with a desired angle of inclination, and a chain conveyor with conveying elements extending between two spaced loops of chain conveys the cut coal from the seam to the mouth. Bucket conveyors, or drag flight conveyors, are preferred. The bucket conveyor can be used for pitch seam mining where the angle of inclination is about 15°–80° from the horizontal, and the drag conveyor can be utilized where the angle of inclination is about 15°–35° from the horizontal. A pair of powered shafts extend from the cutter power source to the cutting heads, and support the chains via sprockets, guides, and the like.

18 Claims, 4 Drawing Sheets

PITCH SEAM MINING

BACKGROUND AND SUMMARY OF THE INVENTION

There are a number of places throughout the world where extensive coal deposits, or like mineral deposits, are present in pitch seams. A pitch seam is a seam having a pronounced angle of inclination with respect to the horizontal. Such seams are almost impossible to mine utilizing conventional auger miners since the augers do not have sufficient conveying effect of the coal to transport the coal to the surface at necessary commercial production levels. Further, such seams are also difficult to deep mine, particularly where they have a relatively narrow "height".

According to the present invention, a method and miner are provided for the high production mining of coal, or like mineral deposits, from pitch seams. The invention is applicable to virtually any pitch seam wherein the angle of inclination is between about 15°-80° from the horizontal. The invention is best suited for seams having a height of about 4 feet or more, and having a substantial depth. Utilizing the invention a minimum production of 25 tons per hour can be achieved, and productions as high as 250 tons per hour are possible.

According to one aspect of the present invention, there is provided a method of mining coal from a pitch seam having an angle of between about 15°-80° from the horizontal utilizing a cutter and conveyor, comprising the steps of: Introducing the cutter into the seam so that it follows the angle of inclination of the seam. Powering the cutter from the mouth of the seam, so that the cutter effects cutting of coal in the seam. Substantially immediately after cutting of coal with the cutter, transporting the coal with the conveyor to a discharge point exterior of the mouth of the seam. And, continually advancing the cutter and lengths of conveyor into the seam until the desired amount of material has been cut.

The method can be practiced where the degree of penetration into the seam is greater than the original length of the conveyor by periodically discontinuing the cutting operation, adding new length to the conveyor, and then resuming continuous penetration. Where a bucket conveyor is utilized, the method may be practiced for essentially any seam having an angle of inclination between about 15°-80°, with production levels as high as 150 tons per hour. For moderate slopes, e.g. about 15°-35°, a drag conveyor can be utilized with expected production levels of as much as 250 tons per hour.

Where the seam is particularly wide, after a first bore of a desired length has been made, the mining equipment can be removed and introduced into the same seam, spaced along the width thereof, to produce another bore in the same manner.

According to another aspect of the present invention, a pitch seam miner is provided. The miner comprises: A power cutting means. A powered conveying means. The conveying means powered separately and distinct from the cutting means. Means for introducing the cutting means into a seam to be mined, at essentially any angle of between about 15°-80° from horizontal. And, means for operatively interconnecting the cutting and conveying means so that the conveying means operatively follows the cutting means and conveys cut material from the interior of the seam to the mouth of the seam.

The power drive for the cutting means preferably comprises a pair of spaced power transmission shafts extending from a power source at the seam mouth to the actual cuttinq heads. The conveyor means preferably comprises a bucket conveyor, drag flight conveyor, or the like supported by the shafts utilizing sprockets and/or guide means. A pair of spiral flight conveyors are also preferably associated with the shaft to move the cut material to the center of the seam, to be picked up by the buckets, or moved by the drag flights.

According to yet another aspect of the present invention, a pitch seam miner is provided comprising: A powered cutting means, including at least one cutting head and power transmission means extending from said cutting head to a power source mounted at the mouth of the seam. A powered conveying means comprising a pair of endless chain loops with a plurality of conveying elements operatively extending between the chain loops. And, means for operatively interconnecting the cutting and conveying means so that the conveying means follows the cutting means and conveys cut material from the interior seam to the mouth of the seam.

It is the primary object of the present invention to provide an effective method and apparatus for pitch seam mining. This and other objects of the invention will become clear from an inspection of the detailed description of the invention, and from the appended claims.

DETAILED DESCRIPTION OF THE DRAWINGS

Figure 1:
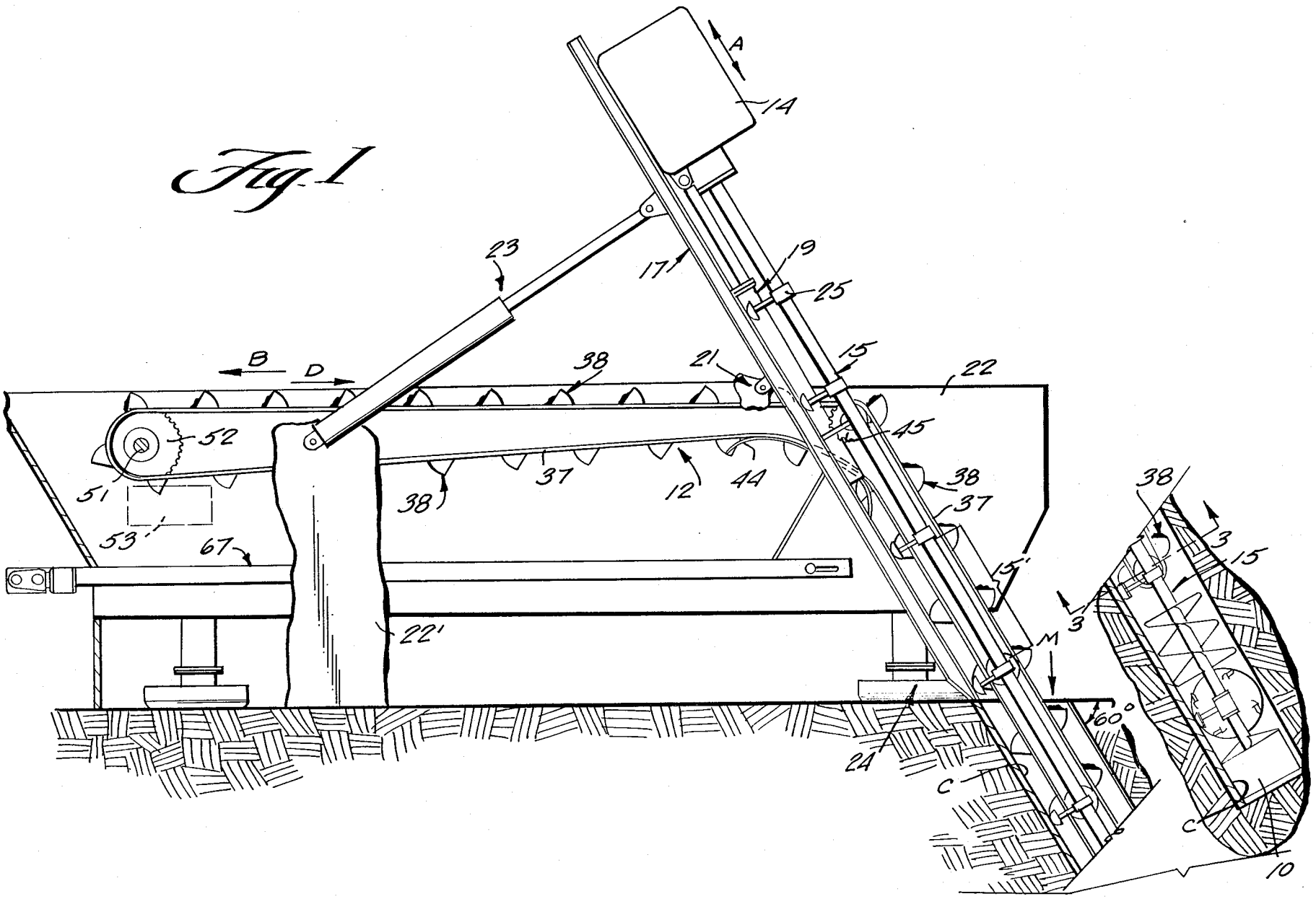
FIG. 1 is a side view, with portions cut away for clarity, of one exemplary form of a miner according to the present invention utilized in the mining of a coal seam having an angle of inclination of about 60°.

An exemplary miner according to the present invention is shown schematically in FIG. 1. The miner includes a powered cutting means including one or more—and preferably a pair of—rotatable cutting heads 10 (see FIGS. 1 and 2), with a powered conveying means—shown generally by reference 12—for conveying coal, or like material, cut by the cutting heads 10 from lower portions of a coal seam C to the mouth M (see FIG. 1) of the seam.

Figure 2:
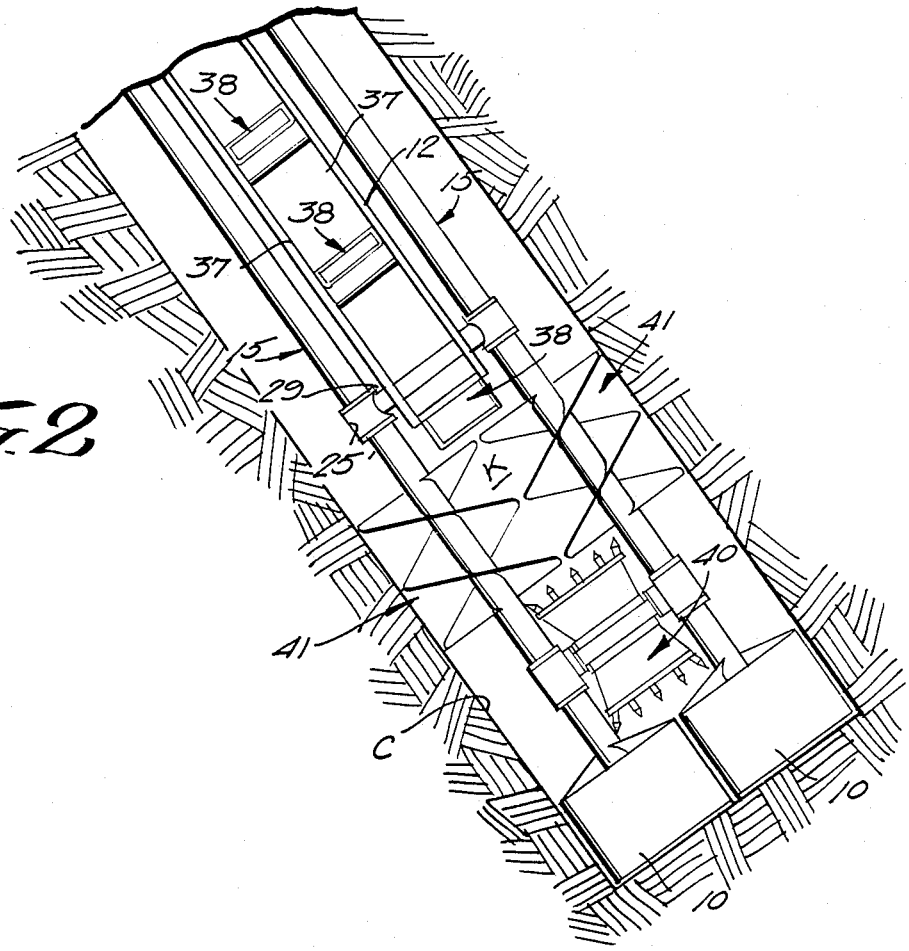
FIG. 2 is a top plan view of the cutting components, and conveying portions adjacent thereto, of the miner of FIG. 1.
Figure 3:
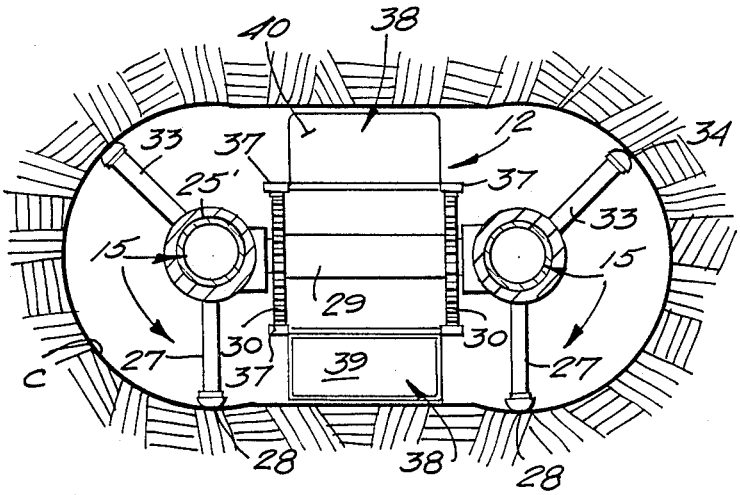
FIG. 3 is a sectional view taken along lines 3—3 of FIG. 1.

A power source, which may be a conventional diesel or electric motor(s) 14 (see FIGS. 1 and 5) is provided for powering the cutting heads 10. The motor 14 is located at the mouth M (exteriorly thereof). Power transmission means, such as a pair of shafts shown generally by reference numeral 15, transmit power from the motor 14 to the cutting heads 10, the shafts 15 spaced as indicated in FIGS. 2 and 3. The shafts 15 are preferably rotated in opposite directions by the motor or motors 14, as illustrated by the directional arrows in FIG. 3.

The motor 14 is mounted on a platform 17, which platform preferably includes a pair of horizontally spaced rails 18 (see FIG. 5) with spaced interconnecting beams 19 therebetween. The motor 14 is mounted by any suitable means on the platform 17 so that it is reciprocal in dimension A (see FIG. 1) to move toward or away from the seam C. One or more hydraulic rams 19 are preferably mounted on the platform 17, and operatively connected to the motor 14, to effect reciprocation in dimension A.

The platform 17 is mounted for pivotal movement, as at pivot points 21 (see FIGS. 1 and 5), to a stationary frame 22, the pivotal movement being about a generally horizontal axis, and the pivot points 21 being at approximately the mid-point of the platform 17. Pivotal movement of the platform 17 about the pivot points 21 may be effected by a pair of hydraulic rams 23 (see FIGS. 1 and 5) which are pivotally connected at one end thereof to the frame 22 and frame components 22', and at the other end thereof to the bottom of the rails 18.

The platform 17, rams 23, and accessory components, provide means for introducing the cutting heads into the seam C at any desired angle between about 15°-60° from the horizontal, a 60° angle of inclination of the seam C—and thus angle of introduction of the cutters 10—being illustrated in FIG. 1. Once the platform 17 has been pivoted to the desired angle of inclination, it is locked in place, as by using a supporting foot such as illustrated by reference numeral 24 in FIG. 1. The motor 14 continuously rotates the shafts 15, and continuously advances the cutting heads 10 as the rams 19 pull the motor 14 down the inclination of platform 17 in dimension A. Once the motor 14 has reached its limit of travel, the motor 14 is disconnected from the shafts 15, moved upwardly along the platform in dimension A by rams 19, and a new section 15' (see FIGS. 1 and 6) of shaft is inserted, including a connecting coupling 25. In this way, the drive components, etc., of the miner according to the invention does not differ substantially from the miner illustrated in U.S. Pat. No. 4,120,535 (see FIGS. 3*b* and 5 in particular).

The conveying means 12 must be operatively interconnected with the cutting means so that the conveying means follows the cutters 10 and conveys cut material from the interior of the seam C to the mouth M. Such interconnection is preferably provided by supporting components attached to the couplings 25 of the shaft segments 15'. For instance as most clearly illustrated in FIG. 6, the connecting collars 25 are supported by legs 27 which are connected to skids 28, which in turn abut the bottom of the seam C.

Figure 6:
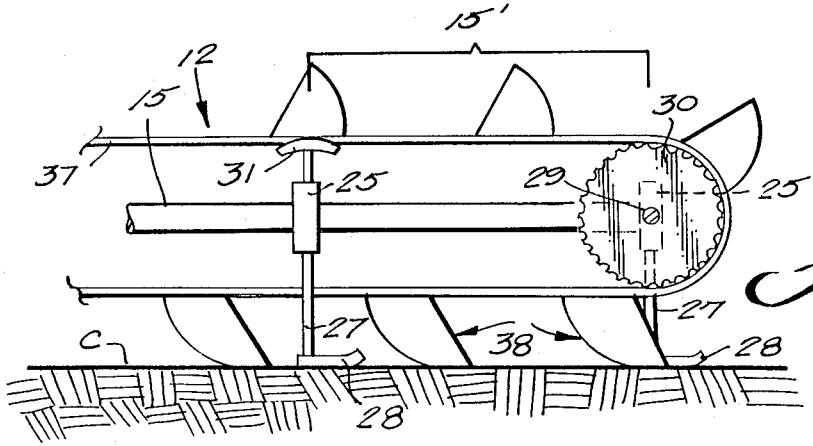
FIG. 6 is a detail side view showing only the operative interengagement between the conveyor and drive transmission component of the miner of FIG. 1.

The collar 25' of the interiormost shaft segment 15' has a shaft 29 extending outwardly therefrom and rotatably mounted therein, the shaft 29 extending generally perpendicular to the shafts 15. Mounted at the ends of the shaft 29 are sprockets 30 which engage the conveying means 12. For least some of the collars 25, additional sprockets—like sprockets 30—are provided; or guide means, such as the arcuate guide 31 illustrated in FIG. 6, are provided for engaging the bottom of the portion of conveyor 12 passing thereover to provide support for that conveyor portion.

As illustrated in FIG. 3, each collar 25, 25' may also have support portions, including legs 33 and skids 34, extending therefrom to engage other portions of the seam C besides the bottom, to stabilize the entire miner within the seam C.

The conveying means 12 in both embodiments comprises a plurality of chain segments connected together to form a pair of endless chain loops 37 (see FIGS. 2 and 3 in particular) of predetermined length, the chain loops 37 being spaced from each other as illustrated in FIGS. 2 and 3, and including conveying elements extending therebetween and connected thereto. In the FIGS. 1 through 3, 5, and 6 embodiment of the invention, the conveying components connected between the chain loops 37 comprise a plurality of buckets 38. Each bucket 38 having an open face 39 (see FIG. 3) at one end thereof, and a closed face 40 at the other end thereof. Typically the buckets 38 would be dimensioned so that they would hold approximately 25-30 pounds of coal or like cut material. Such a conveyor, formed by chain loops 37 with buckets 38 connected therebetween at desired predetermined spaces, is known in the art as a bucket conveyor, or bucket elevator. A typical bucket conveyor is illustrated in U.S. Pat. No. 3,943,644, and bucket conveyors or bucket elevators are commerically available with virtually any desired bucket shape or capacity, or chain link construction, from Link-Belt Company.

As seen most clearly in FIGS. 2 and 3, the chain loops 37 are mounted between the power transmission shafts 15, again utilizing sprockets 30, guide means 31, and the like. Each bucket 38 on the bottom portion of the conveyor advances to the interiormost end of the conveyor 12, at which point it scoops up a load of coal or other cut material. Then the bucket—as illustrated in FIG. 1—carries the cut material up to the mouth M of the seam C. In order to facilitate delivery of the cut material to the buckets 38 from the cutting heads 10, and the optional cusp cutter 40, spiral flight conveyors (auger portions) 41 (see FIG. 2) are preferably provided in association with the segments of the shafts 15 immediately anterior of the end of the conveying means 12. The spiral flight sections 41, combined with the opposite rotation of the shafts 10 (both shafts rotating "inwardly" as illustrated in FIG. 3) moves the cut material to the center section K (see FIG. 2) of the seam C, whereat it is readily picked up by the moving buckets 38.

Exterior of the mouth M of the seam C, the conveyor 12 is redirected so that it moves in a generally horizontal path. This redirection is preferably accomplished utilizing sprockets and/or guides operatively mounted to the platform 17. For instance the arcuate guide segment 44 (see FIG. 1) is mounted to interior portions of the rails 18, while sprockets 45 extend upwardly from the platform 17, the guides 44 engaging the bottom chain links 37 of the conveying means 12, while the sprocket 45 supports the tops of the chain loops 37. Since the platform 17 is constructed with the spaced rails 18, with interconnecting beams provided only at predetermined spaced points along the length thereof, the chain loops 37 and buckets 38 pass between the rails 18 in their movement from the angle of inclination generally corresponding to the angle of inclination (e.g. 60° in FIG. 1) of the pitch seam C, and the horizontal.

Figure 5:
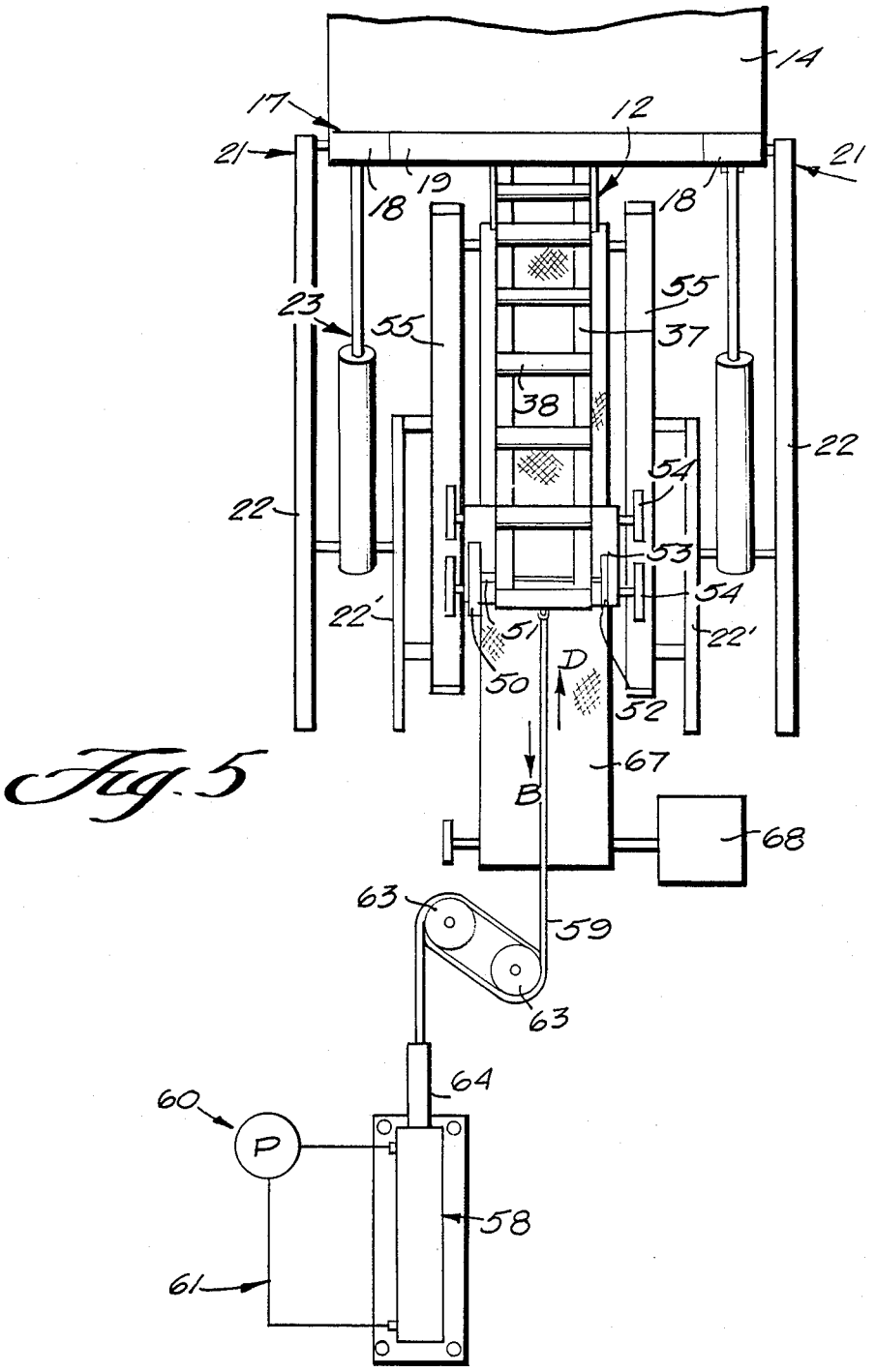
FIG. 5 is a schematic top plan view of the out-of-seam components of the miner of FIG. 1, with portions cut away for clarity.

The conveying means 12 is powered by a power source distinct from the motor 14. Such a power source is shown only schematically by reference numeral 50 in FIG. 5. The power source 50 is operatively connected to drive shaft 51, which in turn is connected to sprockets 52—one of which is shown in FIG. 1—engaging each of the chain loops 37. The power source, which may be a diesel motor or electric motor, must be mounted so that it can move generally horizontally to allow the conveying means 12 to move inwardly into the seam C as the cutting heads 10 advance. This is preferably accomplished—as illustrated most clearly in FIG. 5—by mounting the power source 50 and shaft 51 (and bearing 52 thereof located opposite the power source 50) on a movable carriage 53 having a plurality of wheels 54 supporting it for movement along generally horizontal rails or platforms 55. The platforms 55 are stationarily mounted, as to the frame components 22', as illustrated in FIG. 5.

It is necessary to provide a biasing force to the carriage 53 in the direction B (see FIG. 5) to maintain the chain loops 37 taut. This is preferably accomplished utilizing the hydraulic ram 58, the ram 58 being operatively connected—as by cable 59—to the platform 53. The hydraulic ram 58 is controlled by a variable volume pressure compensated pump 60, and associated fluid circuitry 61, in a manner known per se so as to provide the appropriate biasing force in direction B, while allowing movement of the carriage 53 in direction D, opposite direction B. The stationary ram 58 is preferably operatively connected to the carriage 53 through the cable 59, pulleys 63, and the like in order to maximize the length of travel of the carriage 53 vis-a-vis the length of the piston rod 64 of the ram 58, also in a manner known per se in the art.

The coal, or like cut material, conveyed generally horizontally by the conveying means 12 must be deposited in an appropriate manner at the mouth M so that empty buckets 38 may return to the seam C. This is accomplished according to the present invention by providing the conventional conveyor belt 67 (see FIGS. 4 and 5), powered by conventional power source 68 in direction B, below the generally horizontal portion of the conveyor 12. As each bucket reaches the end of its horizontal length of travel—i.e. at sprockets 52—the bucket 38 turns downwardly (see FIG. 1) and dumps the coal therefrom directly on the top of the conveyor belt 67, the coal then being conveyed in the direction B to any other suitable conveyor, ultimate use source, or the like. As can be seen in FIGS. 1 and 5, the conveyor belt 67 extends below the generally horizontal portion of the conveyor 12 over substantially its entire length of travel in the direction D so that even as the conveyor 12 moves in direction D against the bias of the ram 58, the coal deposited therefrom will fall directly on top of the belt 67.

Once the carriage 53 has moved its maximum extent in the direction D, operation of the miner is temporarily arrested while the chain loops 37 are disconnected at an appropriate point, and a new chain length—with buckets 38—is attached thereto, with the ram 38 returning the carriage 53 to its beginning position (which position for the sprockets 52 is illustrated in FIG. 1). Then operation of the miner may be continued.

Figure 4:
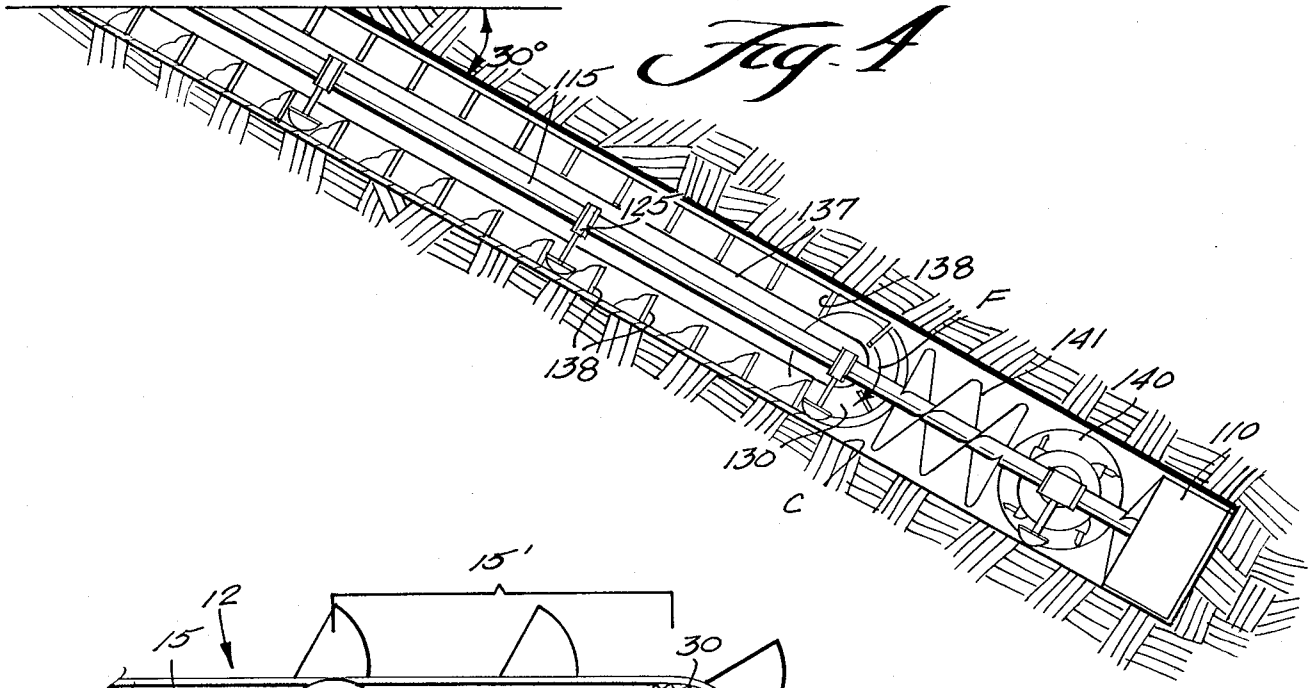
FIG. 4 is a side schematic view of the in-seam components only of another exemplary embodiment of a miner according to the present invention, in this case mining a seam having an angle of inclination of about 30°.

The embodiment illustrated in FIG. 4 is essentially identical to that illustrated in FIGS. 1 through 3, 5, and 6, except for the specific nature of the conveyor. In the FIG. 4 embodiment components corresponding to those in the FIGS. 1 through 3, 5 and 6 embodiment are illustrated by the same reference numeral only preceded by the numeral "1".

In the FIG. 4 embodiment, the chain loops 137 have as the conveying portions thereof the drag flights 138. In this embodiment the chains 137 are powered so that they move around sprocket 130 in the direction indicated by arrow F, so that the flights 138 that actually do the conveying engage the bottom of the seam C and drag the cut coal, or like material, upwardly therealong. At the mouth (not shown) of the seam C for this embodiment, a front end loader, or any other suitable structure, may be provided for removing the cut coal that has been dragged to the mouth, and preferably for at least a short horizontal distance at the mouth. A platform, movable carriage for mounting the chain loops 137, and the like, provided at the mouth of the FIG. 4 embodiment are substantially identical to the corresponding structures for the FIGS. 1 through 3, 5 and 6 embodiment.

The embodiment of FIG. 4 is advantageous in that normally a higher production of coal can be achieved therewith—e.g. up to about 250 tons per hour compared to about 150 tons per hour for the FIGS. 1 through 3, 5 and 6 embodiment—for optimum sized cutting components and the like. However, the miner of FIG. 4 is only useful where the angle of inclination is between about 15°-35° from the horizontal, rather than the about 15°-80° from the horizontal effective range of the miner of the FIGS. 1 through 3, 5 and 6 embodiment.

METHOD

A typical method of pitch seam mining utilizing the apparatus according to the present invention will now be described with respect to the FIGS. 1 through 3, 5, and 6 embodiment. The method of mining coal from a pitch seam having substantially any angle of inclination between about 15°-80° from the horizontal utilizing a cutter and conveyor, comprises the steps of: Introducing the cutters 10 into the seam C so that they follow the angle of inclination of the seam. Powering the cutters 10 from the mouth M of the seam, with engine 14, so that the cutters effect cutting of coal in the seam. Substantially immediately after cutting of coal with the cutters, transporting the cut coal with the conveyor 12 to a discharge point exterior of the mouth M of the seam C. And, continually advancing the cutters 10 and lengths of conveyor 12 into the seam until the desired amount of coal has been cut.

When the distance that the cutters are continuously advanced within the seam is greater than the original length of the conveyor 12, there are further steps of: arresting operation of the cutter 10 once the maximum length of the conveyor has been reached; adding additional conveyor sections to the conveyor to increase its length; and resuming continuous advancement of the cutter into the seam.

Effective high-production mining of coal can be effected for any pitch seam inclination between about 15°-60° from the horizontal. There also may be the further steps of: causing the conveyor to run generally horizontally over at least a portion of the path of movement thereof exterior of the seam mouth, and effecting discharge of the coal from the conveyor while the conveyor is moving generally horizontally.

It will thus be seen that according to the present invention an effective method and apparatus are provided for pitch seam mining. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A pitch seam miner comprising:

a powered cutting means;

a powered conveying means;

said conveying means powered separately and distinct from said cutting means;

means for introducing said cutting means into a seam to be mined, at substantially any angle of inclination of between about 15°-80° from horizontal; and means for operatively interconnecting said cutting and conveying means so that said conveying means operatively follows said cutting means and conveys cut material from the interior of the seam to the mouth of the seam.

2. A miner as recited in claim 1 wherein said means for introducing said cutting means into a seam includes power transmitting means extending from a power source at the seam mouth to the cutting means within the seam.

3. A miner as recited in claim 2 wherein said power transmitting means comprises a pair of spaced shafts, and wherein said spaced shafts include means for supporting said conveying means within the seam, said conveying means mounted within the space between said shafts.

4. A miner as recited in claim 3 wherein said conveying means comprises a bucket conveyor, comprising a single pair of endless loops of chain that are spaced axially from each other, with a plurality of conveyor buckets operatively mounted between the endless loops of chain.

5. A miner as recited in claim 4 wherein said means for operatively interconnecting said cutting and conveying means includes sprockets engaging said chain loops and operatively connected to said shafts, and guide means operatively mounted to said shafts and operatively engaging said chain loops.

6. A miner as recited in claim 4 further comprising means for moving material cut by said cutting means to a central bottom portion of said seam to be picked up by said buckets and conveyed to the seam mouth.

7. A miner as recited in claim 6 wherein said means for moving cut material comprises a pair of spiral flight conveyors, one operatively associated with each of said shafts.

8. A miner as recited in claim 3, operative at substantially any angle of inclination between about 15°-35°, wherein said conveying means comprises a drag flight chain conveyor, having flights disposed between said shafts and for operative association with the bottom of the seam for conveying cut material along the seam bottom.

9. A miner as recited in claim 8 further comprising means for moving material cut by said cutting means to a central bottom portion of said seam to be picked up by said flights and conveyed to the seam mouth.

10. A miner as recited in claim 9 wherein said means for moving cut material comprise a pair of spiral flight conveyors, one operatively associated with each of said shafts.

11. A miner as recited in claim 2 wherein said means for introducing said cutting means into the seam includes a platform mounting a power means for powering said cutting means, so that said power means is reciprocal toward and away from the seam mouth; and means for pivoting said platform about a horizontal axis.

12. A miner as recited in claim 1 wherein said conveying means includes a pair of endless chains of predetermined length having conveying elements attached thereto, and a powered sprocket at said seam mouth, and means for mounting said powered sprocket for biased generally horizontal movement toward and away from said seam mouth.

13. A miner as recited in claim 12 further comprising a hydraulic RAM controlled by a variable volume pressure compensated pump for maintaining a predetermined tension or bias on said means for mounting said sprocket, said RAM operatively connected to said means for mounting said sprocket.

14. A miner as recited in claim 2 wherein said means for introducing said cutting means into the seam includes a platform mounting a power means for powering said cutting means, so that said power means is reciprocal toward and away from the seam mouth; and means for pivoting said platform about a horizontal axis; said platform comprising a pair of spaced rails through which said conveyor chains pass, and guide means operatively attached to said platform for guiding said conveying means so that it moves from an orientation in-line with said seam, to a generally horizontal orientation, or vice-versa.

15. A pitch seam miner comprising:

a powered cutting means, including at least one cutting head and power transmission means extending from said cutting head to a power source mounted at the mouth of the seam;

a powered conveying means comprising a pair of endless chain loops with a plurality of conveying elements operatively extending between said chain loops; and means for operatively interconnecting said cutting and conveying means so that said conveying means follows said cutting means and conveys cut material from the interior seam to the mouth of the seam.

16. A miner as recited in claim 15 wherein said conveying means comprises a bucket conveyor.

17. A miner as recited in claim 15 wherein said conveying means comprises a drag flight conveyor.

18. A miner as recited in claim 15 wherein said miner comprises at least a pair of cutting heads, and wherein said power transmission means comprises a pair of shafts extending from the month of the seam to the cutting heads, and wherein said means for operatively interconnecting said cutting and conveying means comprises sprockets and guide means operatively connected to said shafts and operatively engaging said chains.

* * * * *